US006850130B1

(12) United States Patent
Gottl et al.

(10) Patent No.: US 6,850,130 B1
(45) Date of Patent: Feb. 1, 2005

(54) HIGH-FREQUENCY PHASE SHIFTER UNIT HAVING PIVOTABLE TAPPING ELEMENT

(75) Inventors: Maximilian Gottl, Frasdorf (DE); Roland Gabriel, Griesstätt (DE); Mathias Markof, Halfing (DE)

(73) Assignee: Kathrein-Werke KG, Rosenheim (DE)

( * ) Notice: Subject to any disclaimer, the term of this patent is extended or adjusted under 35 U.S.C. 154(b) by 69 days.

(21) Appl. No.: 10/049,809

(22) PCT Filed: Jul. 27, 2000

(86) PCT No.: PCT/EP00/07236

§ 371 (c)(1),
(2), (4) Date: Feb. 19, 2002

(87) PCT Pub. No.: WO01/13459

PCT Pub. Date: Feb. 22, 2001

(30) Foreign Application Priority Data

Aug. 17, 1999 (DE) ..... 199 38 862

(51) Int. Cl.[7] ..... H01P 1/18
(52) U.S. Cl. ..... 333/161; 333/156
(58) Field of Search ..... 333/156, 161, 333/164, 139; 342/375, 372, 371

(56) References Cited

U.S. PATENT DOCUMENTS

| | | | |
|---|---|---|---|
| 1,764,441 | A | 6/1930 | Hahnemann |
| 1,806,755 | A | 5/1931 | Hansell |
| 2,245,660 | A | 6/1941 | Feldman et al. |
| 2,247,666 | A | 7/1941 | Potter |
| 2,248,335 | A | 7/1941 | Burkhart |
| 2,272,431 | A | 2/1942 | Rankin |
| 2,300,576 | A | 11/1942 | Klein |
| 2,462,881 | A | 3/1949 | Marchetti |
| 2,496,920 | A | 2/1950 | Seeley |
| 2,535,850 | A | 12/1950 | Hammond |
| 2,565,334 | A | 8/1951 | Wingarden |
| 2,566,897 | A | 9/1951 | Koenig |
| 2,583,747 | A | 1/1952 | Potter |
| 2,594,115 | A | 4/1952 | Berney |
| 2,597,424 | A | 5/1952 | Znaidukas |

(List continued on next page.)

FOREIGN PATENT DOCUMENTS

| | | |
|---|---|---|
| AU | B-41625/93 | 6/1993 |
| AU | B 38746/93 | 7/1993 |
| AU | 80057/94 | 5/1995 |

(List continued on next page.)

OTHER PUBLICATIONS

Japanese Book "Antenna for Broadcasting and radio wave transmission" Apr. 20, 1973 by NHK (Nihon Hoso Kyokai.
Japanese Book "Illustrated mobile communication antenna system" Oct. 10, 1996 by Fujimoto.

(List continued on next page.)

*Primary Examiner*—Benny Lee
(74) *Attorney, Agent, or Firm*—Nixon & Vanderhye P.C.

(57) ABSTRACT

An improved radio-frequency phase shift assembly includes at least one further stripline section arranged concentrically with respect to a first stripline section. Further connection lines are provided, via which an electrical connection is produced at least indirectly from the feed line to the respective tapping section associated with a stripline section. Two different pairs of antenna radiating elements can be driven with different phase angles (Φ) at mutually offset tapping points on the at least two stripline sections. The plurality of connection lines are mechanically connected to one another.

25 Claims, 5 Drawing Sheets

U.S. PATENT DOCUMENTS

| | | | |
|---|---|---|---|
| 2,599,048 | A | 6/1952 | Dicke |
| 2,605,413 | A | 7/1952 | Alvarez |
| 2,642,567 | A | 6/1953 | Kimball et al. |
| 2,648,000 | A | 8/1953 | White |
| 2,668,920 | A | 2/1954 | Barrett |
| 2,711,527 | A | 6/1955 | Barrett |
| 2,736,854 | A | 2/1956 | Will |
| 2,745,994 | A | 5/1956 | Dicke et al. |
| 2,787,169 | A | 4/1957 | Farr et al. |
| 2,789,190 | A | 4/1957 | Statham |
| 2,794,162 | A | 5/1957 | Lifsey |
| 2,797,374 | A | 6/1957 | Atton et al. |
| 2,815,501 | A | 12/1957 | Benson et al. |
| 2,825,240 | A | 3/1958 | Gray |
| 2,830,292 | A | 4/1958 | Young |
| 2,831,169 | A | 4/1958 | Casal |
| 2,851,620 | A | 9/1958 | Hausen |
| 2,861,235 | A | 11/1958 | Chadowski et al. |
| 2,872,631 | A | 2/1959 | Blauvelt et al. |
| 2,900,154 | A | 8/1959 | Schweim |
| 2,922,941 | A | 1/1960 | Hensler et al. |
| 2,939,335 | A | 6/1960 | Braund et al. |
| 3,005,985 | A | 10/1961 | Cohn et al. |
| 3,008,140 | A | 11/1961 | Rose |
| 3,043,998 | A | 7/1962 | Lunn et al. |
| 3,205,419 | A | 9/1965 | Voigt |
| 3,248,736 | A | 4/1966 | Bohar |
| 3,276,018 | A | 9/1966 | Butler |
| 3,277,481 | A | 10/1966 | Robin et al. |
| 3,316,469 | A | 4/1967 | Dicke |
| 3,438,035 | A | 4/1969 | Fling et al. |
| 3,491,363 | A | 1/1970 | Young, Jr. |
| 3,508,274 | A | 4/1970 | Kesler et al. |
| 3,527,993 | A | 9/1970 | Ticknor |
| 3,728,733 | A | 4/1973 | Robinson |
| 3,826,964 | A | 7/1974 | Byrne |
| 3,864,689 | A | 2/1975 | Young |
| 3,886,559 | A | 5/1975 | Lanson et al. |
| 3,886,560 | A | 5/1975 | Mortensen et al. |
| 4,077,000 | A | 2/1978 | Grubbs |
| 4,101,902 | A | 7/1978 | Trigon |
| 4,163,235 | A | 7/1979 | Schultz |
| 4,263,539 | A | 4/1981 | Barton |
| 4,301,397 | A | 11/1981 | Journey |
| 4,314,250 | A | 2/1982 | Hanell et al. |
| 4,316,195 | A | 2/1982 | Steffek et al. |
| 4,335,388 | A | 6/1982 | Scott et al. |
| 4,413,263 | A | 11/1983 | Amitay et al. |
| 4,460,897 | A | 7/1984 | Gans |
| 4,467,328 | A | 8/1984 | Hacker |
| 4,496,890 | A | 1/1985 | Wurdack et al. |
| 4,542,326 | A | 9/1985 | Hornback |
| 4,543,583 | A | 9/1985 | Wurdack |
| 4,617,572 | A | 10/1986 | Hugo |
| 4,694,773 | A | 9/1987 | Sparkes et al. |
| 4,796,032 | A | 1/1989 | Sakurai et al. |
| 4,862,179 | A | 8/1989 | Yamada |
| 4,882,587 | A | 11/1989 | Vodopia |
| 5,012,256 | A | 4/1991 | Maddocks |
| 5,021,798 | A | 6/1991 | Ubhayakar |
| 5,038,148 | A | 8/1991 | Aoki et al. |
| 5,077,560 | A | 12/1991 | Horton et al. |
| 5,084,708 | A | 1/1992 | Champeau et al. |
| 5,093,923 | A | 3/1992 | Leslie |
| 5,099,247 | A | 3/1992 | Basile et al. |
| 5,151,704 | A | 9/1992 | Gunmar et al. |
| 5,151,706 | A | 9/1992 | Roederer et al. |
| 5,175,556 | A | 12/1992 | Berkowitz |
| 5,241,319 | A | 8/1993 | Shimizu |
| 5,272,477 | A | 12/1993 | Tashima et al. |
| 5,281,975 | A | 1/1994 | Hugo |
| 5,300,935 | A | 4/1994 | Yu |
| 5,303,240 | A | 4/1994 | Borras et al. |
| 5,339,083 | A | 8/1994 | Inami |
| 5,504,466 | A | 4/1996 | Chan-Son-Lint et al. |
| 5,504,937 | A | 4/1996 | Kangas |
| 5,539,413 | A | 7/1996 | Farrell et al. |
| 5,572,219 | A | 11/1996 | Silverstein et al. |
| 5,596,329 | A | 1/1997 | Searle et al. |
| 5,917,455 | A * | 6/1999 | Huynh et al. ..... 333/161 |
| 6,239,744 | B1 | 5/2001 | Singer et al. |
| 6,538,619 | B2 | 3/2003 | Heinz et al. |
| 6,567,051 | B2 | 5/2003 | Heinz et al. |
| 6,590,546 | B2 | 7/2003 | Heinz et al. |
| 6,600,457 | B2 | 7/2003 | Heinz et al. |
| 2002/0113750 | A1 | 8/2002 | Heinz et al. |
| 2002/0126059 | A1 | 9/2002 | Zimmerman et al. |
| 2003/0048230 | A1 | 3/2003 | Heinz et al. |

FOREIGN PATENT DOCUMENTS

| | | |
|---|---|---|
| AU | B-36226/95 | 5/1996 |
| CH | 2 75 290 A | 8/1951 |
| DE | 584 383 | 9/1933 |
| DE | 827 085 B | 1/1952 |
| DE | 907 193 B | 3/1954 |
| DE | 908 748 | 4/1954 |
| DE | 945 261 | 7/1956 |
| DE | 1 768 660 | 6/1958 |
| DE | 1 033 280 | 7/1958 |
| DE | 1 826 656 | 2/1961 |
| DE | 1 133 775 | 7/1962 |
| DE | 1 293 251 | 4/1964 |
| DE | 2 249 806 | 4/1973 |
| DE | 2 207 894 | 8/1973 |
| DE | 2 359 846 | 6/1974 |
| DE | 26 25 062 A1 | 12/1977 |
| DE | 26 31 273 | 1/1978 |
| DE | 24 58 477 | 5/1978 |
| DE | 29 21 712 | 12/1979 |
| DE | 29 38 370 | 4/1980 |
| DE | 28 55 623 A1 | 7/1980 |
| DE | 29 51 875 C2 | 7/1980 |
| DE | 31 34 219 A1 | 3/1983 |
| DE | 34 25 351 C2 | 1/1985 |
| DE | 35 22 404 A1 | 1/1987 |
| DE | 38 31 994 A 1 | 3/1990 |
| DE | 38 39 945 A1 | 5/1990 |
| DE | 39 02 739 A1 | 8/1990 |
| DE | 39 34 716 A1 | 4/1991 |
| DE | 39 37 294 A1 | 5/1991 |
| DE | G 91 08 641.8 | 10/1991 |
| DE | 31 02 110 A1 | 8/1992 |
| DE | 42 01 933 C2 | 7/1993 |
| DE | 42 42 803 A1 | 7/1993 |
| EP | 0 156 294 | 10/1985 |
| EP | 0 466 080 A1 | 1/1992 |
| EP | 0 575 808 A1 | 12/1993 |
| EP | 0 579 407 B1 | 1/1994 |
| EP | 0 600 715 B1 | 6/1994 |
| EP | 0 616 741 B1 | 9/1994 |
| EP | 0 618 639 A2 | 10/1994 |
| EP | 0 639 035 A1 | 2/1995 |
| EP | 0 682 820 B1 | 11/1995 |
| EP | 789 938 A1 | 8/1997 |
| EP | 789 938 A4 | 4/1999 |
| EP | 1 239 534 A2 | 9/2002 |
| EP | 1 239 535 A2 | 9/2002 |
| EP | 1 239 536 A2 | 9/2002 |
| EP | 1 239 538 A2 | 9/2002 |
| FR | 959833 | 4/1950 |
| FR | 70.39506 | 8/1971 |

| | | | | |
|---|---|---|---|---|
| FR | 2 603 426 | | 3/1988 | |
| GB | 1 044 789 | | 11/1963 | |
| GB | 1 029 865 | | 5/1966 | |
| GB | 1 175 365 | A | 12/1969 | |
| GB | 1 271 346 | A | 4/1972 | |
| GB | 1 314 693 | | 4/1973 | |
| GB | 1 470 884 | A | 4/1977 | |
| GB | 1 505 074 | A | 3/1978 | |
| GB | 2 034 525 | A | 6/1980 | |
| GB | 1 577 939 | A | 10/1980 | |
| GB | 2 044 567 | A | 10/1980 | |
| GB | 2 161 026 | A | 1/1986 | |
| GB | 2 262 009 | A | 6/1993 | |
| JP | 57-184303 | | 11/1982 | |
| JP | 63-6906 | | 1/1988 | |
| JP | 1-140802 | | 6/1989 | |
| JP | 02 132 926 | | 5/1990 | |
| JP | 7-79476 | | 3/1991 | |
| JP | 03 057 305 | A | 3/1991 | |
| JP | 3-85906 | | 4/1991 | |
| JP | 3-151701 | | 6/1991 | |
| JP | 4-196904 | | 7/1992 | |
| JP | 5-37222 | | 2/1993 | |
| JP | 3-279795 | | 5/1993 | |
| JP | 5-121902 | | 5/1993 | |
| JP | 5-121915 | | 5/1993 | |
| JP | 5121915 | * | 5/1993 | ..... 333/161 |
| JP | 6-125216 | | 5/1994 | |
| JP | 6-204738 | | 7/1994 | |
| JP | 6-232621 | | 8/1994 | |
| JP | 6-268429 | | 9/1994 | |
| JP | 5-110283 | | 11/1994 | |
| JP | 5-110284 | | 11/1994 | |
| JP | 6-326501 | | 11/1994 | |
| JP | 06-326 501 | | 11/1994 | |
| JP | 06-326 502 | | 11/1994 | |
| JP | 06 334 428 | | 12/1994 | |
| JP | 6-338717 | | 12/1994 | |
| JP | 7-170121 | | 7/1995 | |
| JP | 07-245579 | | 9/1995 | |
| JP | 7-318627 | | 12/1995 | |
| JP | 8-32341 | | 2/1996 | |
| JP | 8-172388 | | 7/1996 | |
| JP | 9-246846 | | 9/1997 | |
| JP | 10-508730 | | 8/1998 | |
| NZ | 204522 | | 1/1986 | |
| NZ | 208213 | | 10/1987 | |
| NZ | 219746 | | 8/1989 | |
| NZ | 220276 | | 9/1989 | |
| NZ | 235010 | | 12/1993 | |
| NZ | 248075 | | 3/1996 | |
| NZ | 274931 | | 10/1996 | |
| NZ | 293722 | | 5/1997 | |
| NZ | 334357 | | 4/1999 | |
| NZ | 333811 | | 4/2000 | |
| NZ | 333634 | | 10/2000 | |
| SU | 1 337 951 | | 9/1987 | |
| WO | WO 90/14563 | | 11/1990 | |
| WO | WO 92/16061 | A1 | 9/1992 | |
| WO | WO 93/12587 | | 6/1993 | |
| WO | WO 94/09568 | A1 | 4/1994 | |
| WO | 96/37009 | | 11/1996 | |
| WO | 96/37922 | | 11/1996 | |
| WO | 98/21779 | | 5/1998 | |
| WO | WO 02/061877 | | 8/2002 | |

OTHER PUBLICATIONS

Japanese Book "Antenna Engineering" Sep. 30, 1969 Endo et al.

Mobile Telephone Panel Array (MPTA) Antenna : Field Adjustable Downtilt Models Australia May 1994.

"Design Specification for Premium antenna with EDT and AS" Telecom Australia Sep. 1993.

Kumar Fixed and mobile terminal antennas 1991 Artech House, Inc.

News of higher education establishments, Radio electronics. Technical–scientific journal Higher Education Ministry of USSR, Kiev, 1985–1991.

Measuring Technique. Monthly scientific–technical journal. State Committee of USSR on standards. Moscow, Standards publishing house, 1985–1990.

Radio. Popular monthly radio technical magazine. Moscow, 1987–1996.

Radio Technic. Scientific–technical journal. Popov Radio Technic, Electronics and Communication Socient. Moscow, publishing house "Radioand Communications," 1985–1995.

Radio Engineering and Electronics. Academy of Sciences of USSR, Moscow, "Nauka," 1985–1995.

Electric Communication. Monthly scientific–technical journal. Communication Ministry of USSR and Popov Radio Technic. Electronics and Communication Society. Moscow, publishing house "Radio and Communications," 1987–1995.

Monthly scientific–technical journal. Electrical Engineering Ministry and Krzyzanovski Center. Moscow, "Energoatomizdat," 1985–1995.

Phased Antenna array, M.B. Zakson, Great Soviet Encyclopedia, 3rd edition, Moscow. Sovetskaya Entsiklopediya, 1977, vol. 27, Ulyanovsk–Frankfurt, p. 182–184.

Phased Antenna arrays, Antennas. A.L. Drabkin, Ye. B. Korenberg. Moscow, "Radio I svyaz." 1992 (Popular library, issue 1173), Chapter 9 "Antenna arrays," pp. 109–114.

Antenna arrays with phase scanning. Antennas of radiolocation stations. V.G. Glagolevski, Yu. A. Shishov. Moscow, "Voyenizdat," 1977. –n Chapter [2]: Antenna arrays, pp. 44–48. Radiolocation technique.

Phased Antenna arrays. Antennas. Manual for students of radio engineering higher educational establishments. G.T. Markow, D.M. Sazonov, 2nd edition. Moscow, "Energiya," 1975. Chapter 14 "Scanning Antenna arrays," pp. 462–468.

Kumm et al 1983 Phasengesteuerte Planarantennengruppen fur den Empfangsbereich um 12 Gigahertz.

* cited by examiner

HIGH-FREQUENCY PHASE SHIFTER UNIT HAVING PIVOTABLE TAPPING ELEMENT

CROSS-REFERENCES TO RELATED APPLICATIONS

This application is related to applicants' co-pending application Ser. No. 10/240,317 filed Oct. 1, 2002.

FIELD

The invention relates to a radio-frequency phase shift assembly.

BACKGROUND AND SUMMARY

Phase shifters are used, for example, for trimming the delay time of microwave signals in passive or active networks. As a known principle, the delay time of a line is used to trim the phase angle of a signal and, in consequence, a variable phase angle means that the lines have different electrically effective lengths.

For applications in antennas with an electrically adjustable notch in the polar diagram, the signals have different delay times to the individual radiating elements, for example dipoles. The difference in the delay times between two adjacent radiating elements is approximately the same for a specific notch angle in an array of radiating elements arranged vertically one above the other. This delay time difference is also increased for larger notch angles. If the phase angles of the individual radiating elements are varied by means of phase shift assemblies, then this is an antenna with an adjustable electrical notch in the polar diagram.

According to WO 96/37922, a phase shift is known which has electrically moveable plates in order to produce a phase difference between different outputs, but at least between two outputs. This has the disadvantage that the movement of the dielectric plates also changes the impedance of the respectively affected lines, and the way in which the power of the signals is shared depends on the setting of the phase shifter.

The prior publication WO 96/37009 proposes a symmetrical line branching system in order to emit the same power at both ends of this line. This can be done provided that both ends are terminated by the characteristic impedance of this line. Comparable solutions of these technical principles have already been used for a long time for mobile radio antennas. However, these solutions have the disadvantage that only two radiating elements can be supplied, and they also still receive the same power. A further disadvantage is the moving electrically conductive connection between the input and the respective lines. Electrically high-quality contacts may exhibit undesirable nonlinearities.

In principle, it is also known for a number of phase shifters to be integrated in one antenna. Such phase shifters can supply the individual radiating elements in the entire antenna arrangement. Individual radiating elements have different phase differences, and the phase shift assembly settings differ for the individual radiating elements. This necessitates complex mechanical step-up transmission systems such as illustrated, in principle, in FIG. 1, which shows a corresponding design according to the prior art.

To this end, and in order to illustrate the prior art, FIG. 1 shows, schematically, an antenna array 1 having, for example, five dipole elements 1*a*, 1*b*, 1*c*, 1*d*, 1*e* which are fed via a feed input 5.

The feed input 5 is followed by a distribution network ("||S||") 7 which, in the illustrated example, supplies two RF phase shift assemblies 9', 9" with each of the two phase shift assemblies supplying two dipoles.

A feed line 13 passes from the distribution network 7 to a central dipole radiating element 1*c*, which is driven without any phase shift.

The other dipoles are supplied with different phases, depending on the setting of the phase shift assembly 9, with, for example:

the dipole 1*a* supplied with a phase $+2\Phi$, the dipole radiating element 1*b* supplied with a phase $+1\phi$, the central dipole radiating element 1*c* supplied with the phase $\phi=0$, the fourth dipole radiating element 1*d* supplied with the phase $-1\phi$, and the last dipole radiating element 1*e* supplied with the phase $-2\phi$.

In consequence, the phase shift assembly 9' therefore ensures a split of $+2\phi$ and $-2\phi$, and the second phase shift assembly 9" ensures a phase shift of $+\phi$ and $-\phi$, for the respectively associated dipole radiating elements 1*a*, 1*e* and 1*b*, 1*d*, respectively. A correspondingly different setting for the phase shift assemblies 9', 9" can then be ensured by a mechanical actuating drive 17. In this example, a comparatively complex mechanical step-up transmission drive 17 is used to produce the different phase differences required for the respective individual radiating elements.

A phase shift assembly of this generic type is known from PATENT ABSTRACTS OF JAPAN Vol. 1998 No. 1, Jan. 30, 1998 (1998-01-30) & JP 09 246846 A (NTT IDO TSUSHINMO KK), Sep. 19, 1997 (1997-09-19). This prior publication covers two stripline segments which are in the form of circle segments and are arranged offset with respect to one another in the circumferential direction and at a different distance from a central center point. A tapping element can be moved about this center point, engaging with the respective stripline segment. The tapping element in this case comprises two radial elements. The two radial elements are offset with respect to one another with an angular separation in plan view, and are connected to one another at the center point, which lies on their pivoting axis.

Exemplary illustrative non-limiting implementations of the technology herein provide an improved phase shift assembly which has a simpler design and, particularly in the case of an antenna array using at least four radiating elements, allows an improvement to the control and setting of the phases of the individual radiating elements. In this case, power sharing, in particular in pairs, between at least four radiating elements is preferably intended to be possible at the same time.

Exemplary illustrative non-limiting implementations of the technology herein provide a phase shift assembly which is compact and, has a higher integration density. Furthermore, additional connection lines, solder points and transformation means for providing the power sharing are minimized. There is also no need for the step-up transmission system to produce and to set the different phase angles for the radiating elements.

Exemplary illustrative non-limiting implementations of the technology herein provide at least two stripline segments in the form of circle segments. They interact with a tapping element. The tapping element is connected to a feed point, and forms a moveable tap or coupling point in the overlapping area with the respective circular stripline segment. A common connection line, which extends as far as the outermost circle segment, leads from the common feed point to the individual circle segments.

As mentioned, the stripline segments may be in the form of circle segments. The stripline sections may, in general terms, also be provided arranged concentrically with respect to one another. Such arrangement may also include stripline sections which run in a straight line and are arranged parallel to one another (namely for the situation where the radius of the stripline sections which are in the form of circle segments becomes infinite).

One exemplary simple refinement comprises providing a tapping element which passes over a number of stripline segments in the form of circle segments, like a radially running pointer. Such arrangement hence forms a number of associated tapping points which are located one behind the other in individual stripline segments.

A type of bridge structure is also possible. Connection lines which run in the same direction are arranged one above the other when seen in a horizontal side view. They can be moved about a common pivoting axis, and are rigidly connected to form a common tapping element, which can be handled.

The feed to the common rotation point is preferably capacitive. The tapping point between the tapping element and the respective circular stripline segment is also capacitive.

Exemplary illustrative non-limiting implementations of the technology herein also allow transmitting power to be shared, for example, in such a manner that the power decreases or increases from the inner to the outer circular stripline segment or, if required, even allows the power to all the stripline segments to remain more or less constant.

Furthermore, it has been found to be advantageous for the radio-frequency phase shift assembly to be formed on a metallic base plate, which is preferably formed by the reflector of the antenna. In addition, it has been found to be advantageous for the phase shift assembly to be shielded by a metallic cover.

The distances between the circle segments may differ. The diameter of the stripline segments preferably increases by a constant factor from the inside to the outside. The distances between the circle segments may in this case preferably transmit 0.1 to about 1.0 times the transmitter RF wavelength.

One simple exemplary implementation of the phase shift assembly can also allow the circle segments and connection lines to be formed together with a cover as triplate lines.

BRIEF DESCRIPTION OF THE DRAWINGS

These and other exemplary illustrative non-limiting features and advantages will be better and more completely understood by referring to the following detailed description in conjunction with the drawings, of which.

DETAILED DESCRIPTION OF EXAMPLE NON-LIMITING IMPLEMENTATIONS

Figure 2:
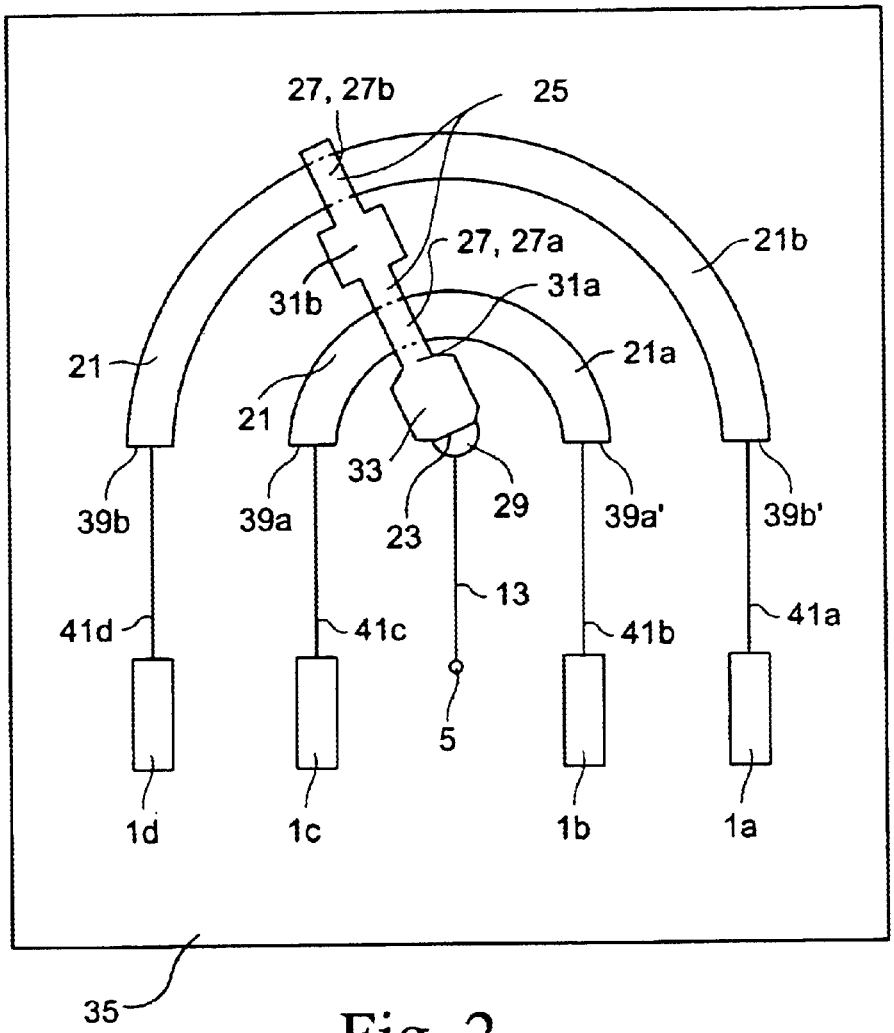
FIG. 2 shows a schematic plan view of an exemplary illustrative non-limiting implementation of a phase shift assembly for driving four radiating elements.

A first exemplary implementation of a radio-frequency phase shift assembly has stripline sections 21 offset with respect to one another as shown in FIG. 2. Stripline segments 21 are provided in the form of circle segments in the illustrated exemplary embodiment. An inner stripline segment 21*a* and an outer stripline segment 21*b* are arranged concentrically around a common center point in a plan view and through which a vertical pivoting axis 23 runs at right angles to the plane of the drawing.

A tapping element 25, which is designed such that it runs essentially radially in the plan view shown in FIG. 2, runs from the pivoting axis 23. In each case, tapping element 25 forms a coupled tapping section or tapping point 27 in the respective area in which it overlaps an associated stripline segment 21. Two tapping points 27*a*, 27*b* are provided, in this example which are offset in the longitudinal direction of the tapping element 25.

The feed line 13 passes from the feed input 5 to a center tap 29. In that region, a pivoting axis 23 for the tapping element 25 is located.

The tapping element 25 includes a first connection line 31*a*. Connection line 31*a* extends from the coupling section 33 in the overlapping area of the center tap 29 to the tapping point 27*a* on the inner stripline segment 21*a*. The region which projects as an extension beyond this tapping point 27*a* forms the next connection section or connection line 31*b*. Connection line 31*b* leads to the tapping point 27*b* which is formed in the region in which it overlaps the outer stripline segment 21*b*. The distance between the stripline segments 21*a*–21*d* may be for example 0.1 to 1.0 times the transmitted RF wavelength.

The entire RF phase shift assembly is designed with the four dipoles 1*a*, 1*b*, 1*c*, 1*d* which are shown in the exemplary embodiment in FIG. 2 jointly on a metallic base plate 35, which also provides the reflector 35 for the dipoles 1*a*, 1*b*, 1*c*, 1*d*. Stripline segment 21*a* (see also FIG. 3) includes ends 39*a*, 39*a*' which connect to antenna elements 1*c*, 1*b* through connections 41*c*, 41*b*, 41*a*, respectively and stripline segment 21*b* (see also FIG. 3) includes ends 39*b*, 39*b*' which connect to antenna elements 1*c*, 1*b* through connections 41*d*, 41*a* respectively.

Figure 3:
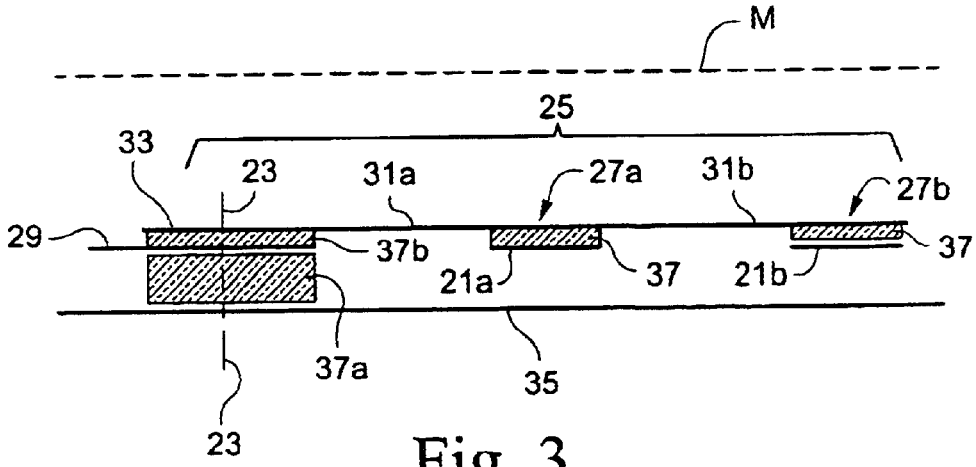
FIG. 3 shows a schematic section along the tapping element in FIG. 2, in order to explain the exemplary non-limiting capacitive coupling of the phase shift segment and of the center tap.

In the horizontal cross-sectional illustration shown in FIG. 3, it can be seen that the coupling is capacitive not only at the center tap 29 but also at the tapping points 27*a*, 27*b*. In this example case, low-loss dielectrics 37 provide the capacitive coupling and, at the same time, provide the mechanical fixing both for the center tap 29 and for the tapping points 27*a*, 27*b* which are radially offset with respect to it.

The base section of the center tap 29 is provided, offset with respect to the reflector plate 35, above a dielectric conical section 37*a* which has a greater axial height. The coupling layer 33, through which, like the center tap 29, the pivoting axis 23 likewise passes, is located above this, separated by a relatively thin dielectric conical layer 37*b*.

The cross-sectional illustration in FIG. 3 also shows that the stripline segments 21*a*, 21*b*, which are in the form of circle segments, are likewise located at the same distance as the center tap 29 from the reflector plate 35, and are coupled to the tapping element 25 via the dielectric 37 that is formed there. The tapping element 25 is in this case a uniformly rigid lever, which can be moved about the pivoting axis 23. See description of FIG. 2 above for similarly labeled elements. In addition, it has been found to be advantageous for the phase shift assembly to be shielded by a metallic cover M.

Rotation of the tapping element 25 about the pivoting axis 23 now allows the phase to be set, with the appropriate phase offset from +2Φ to −2Φ, jointly for all the dipole radiating elements 1*a*, 1*b*, 1*c*, 1*d*. See FIG. 2.

Suitable selection of the characteristic impedances and suitable regions of the connections 31*a* and 31*b* between the corresponding tapping points 29 as well as tapping points 27*a* and 27*b*, respectively, now allows the power to be shared at the same time between the dipole radiating elements 1*a* and 1*d*, on the one hand, and the further pair of dipole radiating elements 1*b* and 1*c*. The dipole antennas 1*a* to 1*d* are connected via antenna lines 41 to each end 39*a* and 39*b*, respectively, of the stripline segments 21*a*, 21*b*, which are in the form of circle segments (see FIG. 2).

Figure 4:
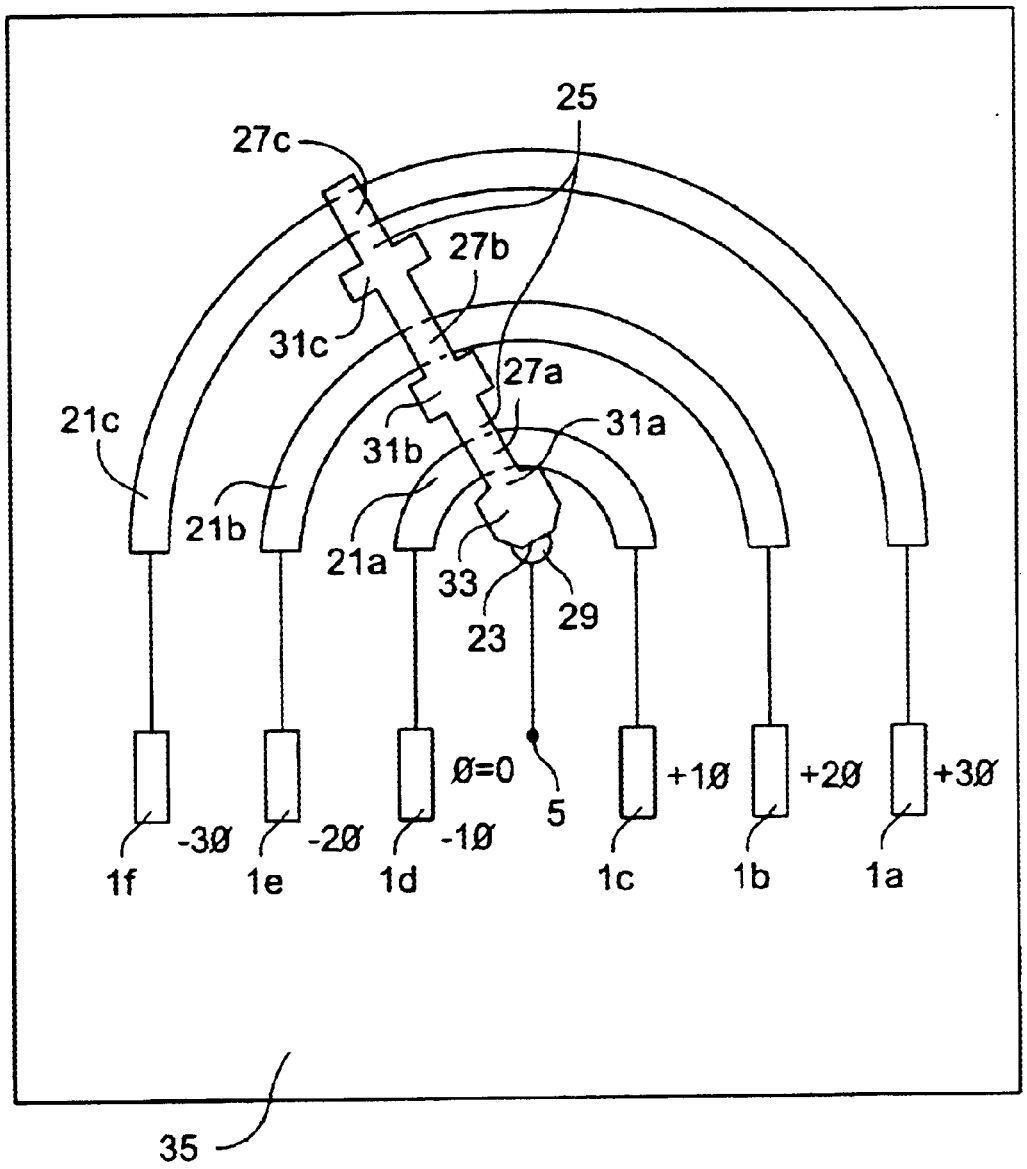
FIG. 4 shows a modified exemplary non-limiting implementation of a phase shift assembly having three circle segments.

A modified exemplary implementation with a total of six dipole radiating elements 1*a*, 1*b*, 1*c*, 1*d*, 1*e*, If is shown in FIG. 4, allowing phase shifts from −3ϕ, −2ϕ, −ϕ0, +ϕ, +2ϕ, +3ϕ to be achieved in this case (similarly labeled elements as compared to FIG. 2 have similar functions). Furthermore, if required, it is possible to achieve power sharing, for example from outside to inside, which allows power steps of 0.5:0.7:1. Description of similarly labeled elements in FIG. 2 will not be repeated here.

Figure 1:
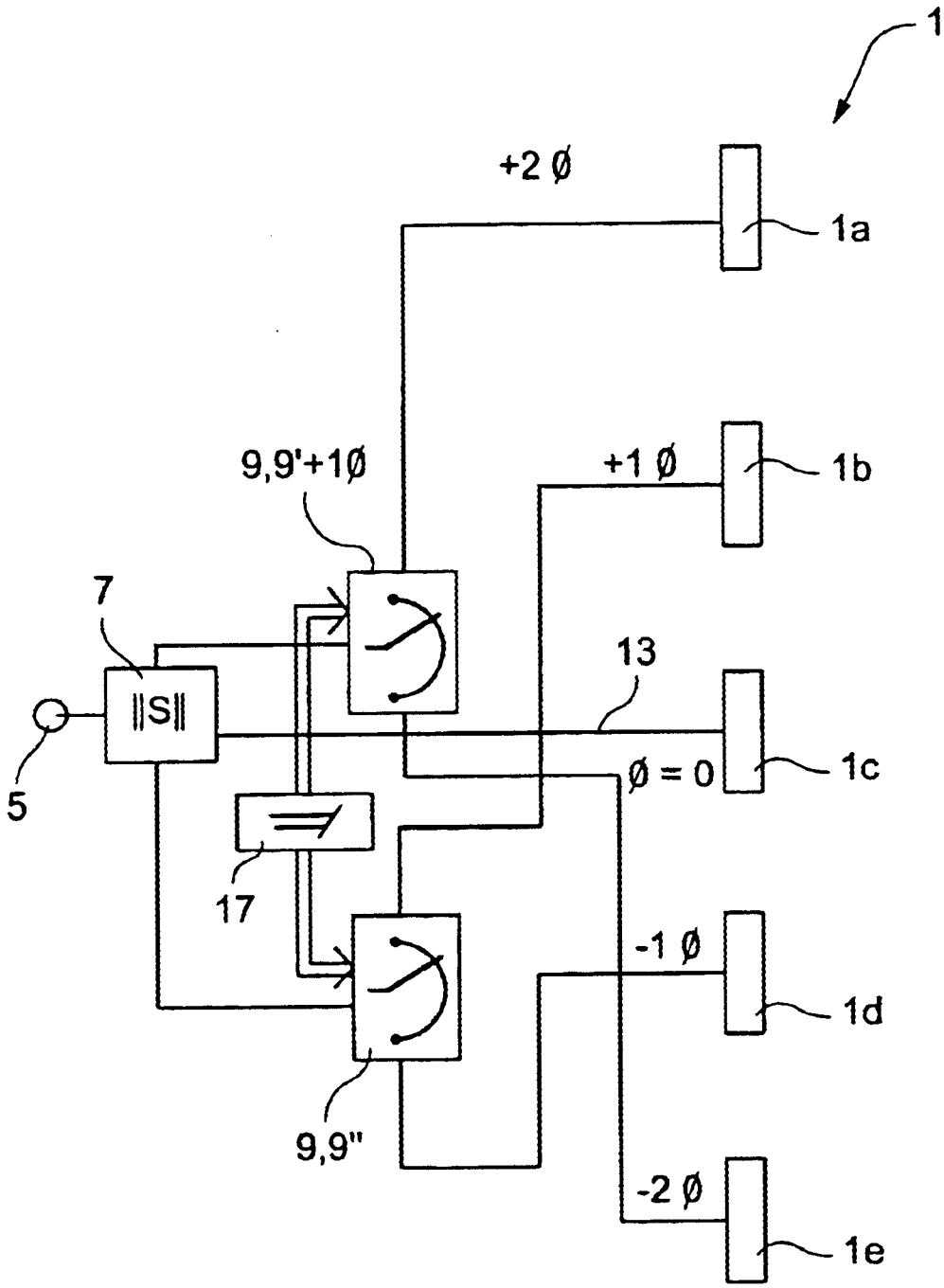
Fig. 1 (PRIOR ART)
FIG. 1 shows a schematic illustration of an exemplary prior art radio-frequency phase shift assembly for feeding five dipoles.

In this exemplary embodiment, as in the previous exemplary embodiment, a central dipole radiating element or a central dipole radiating element group, as is shown in FIG. 1, may also be provided, which has a phase shift angle of 0° and is directly connected to the feed line input.

Figure 5:
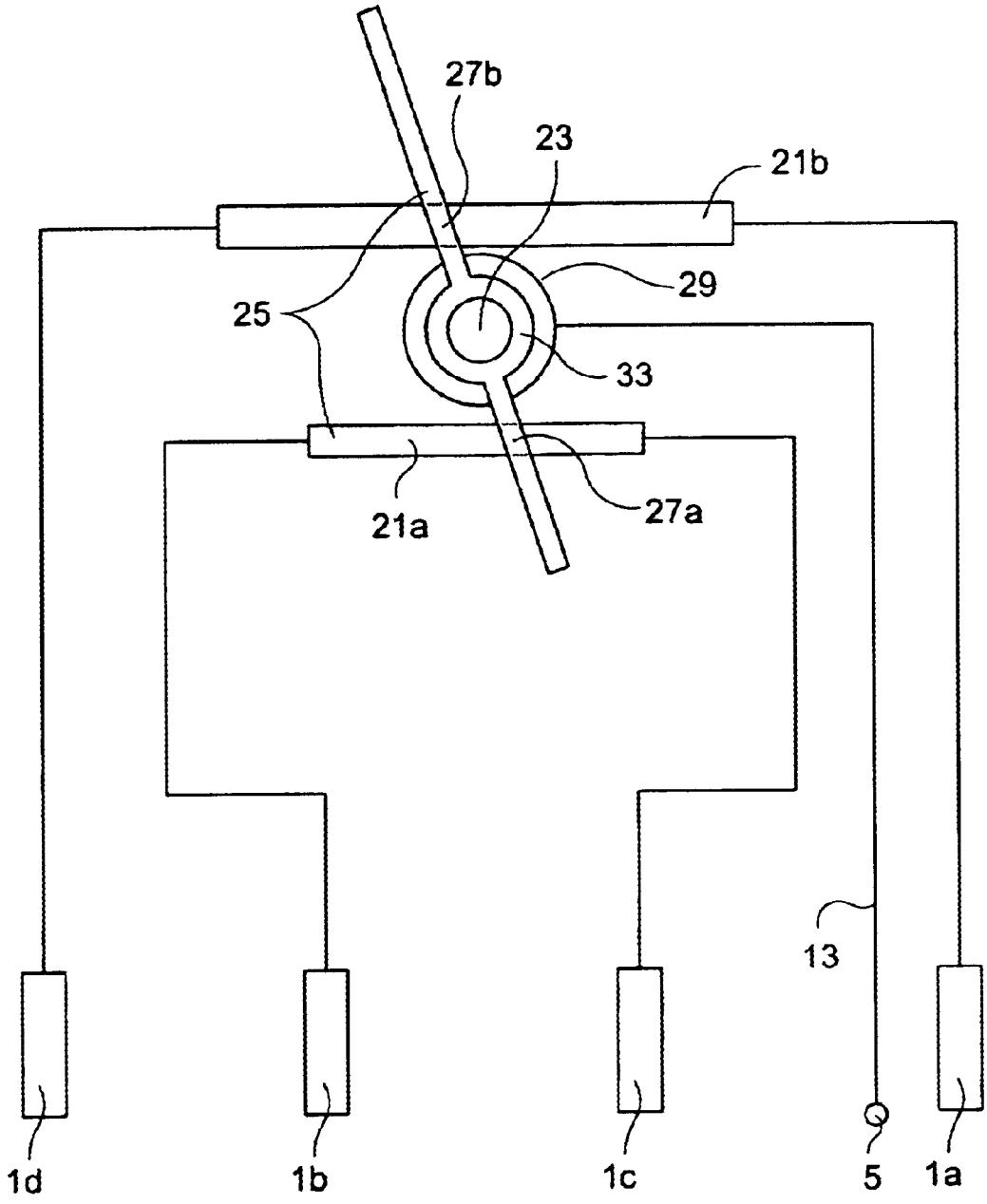
FIG. 5 shows a modified exemplary implementation using two stripline sections which are not in the form of circle segments (which run in straight lines)

FIG. 5 shows two straight stripline sections 21*a* and 21*b*, which are offset with respect to one another and, in the illustrated exemplary implementation, are offset with respect to one another through 180° with respect to the pivoting axis 23 (similarly labeled elements as compared to FIG. 2 have similar functions). A conversion would be feasible to the extent that the stripline sections 21*a* and 21*b*, which are shown in FIG. 5, are arranged such that they run parallel to one another and run in straight lines, are arranged on the same side of the center tap 29 and, at the same time, are covered by a single tapping element 25 in the form of a pointer. Description of similarly labeled elements in FIG. 2 will not be repeated here.

Figure 6A:
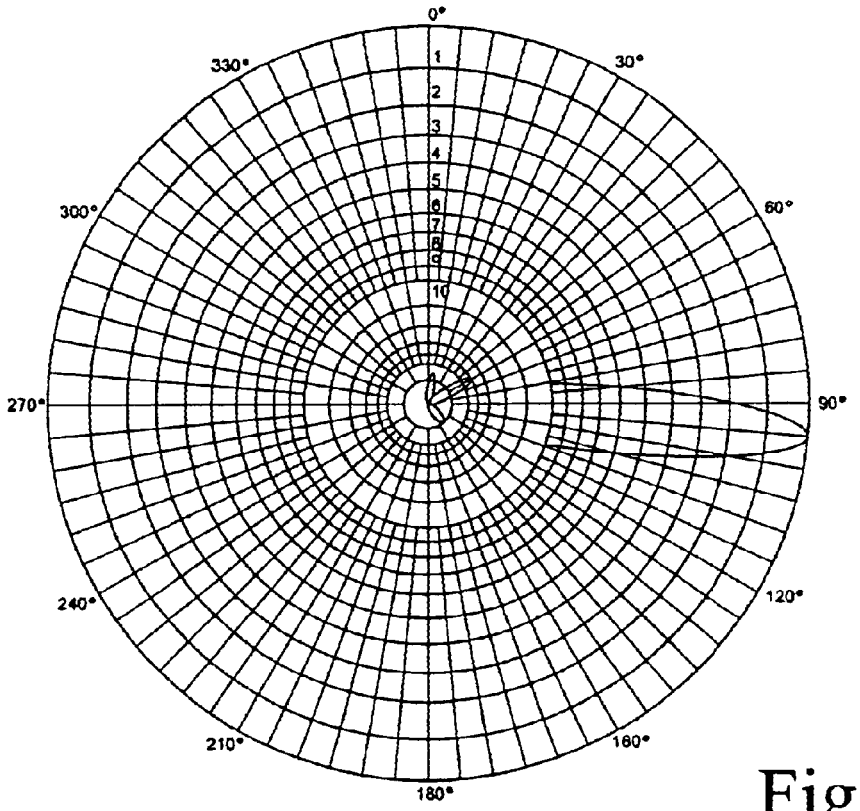
FIGS. 6*a* and 6*b* show a polar diagram of an antenna array with an adjustable electrical notch at 4°, and 10°, respectively.
Figure 6B:
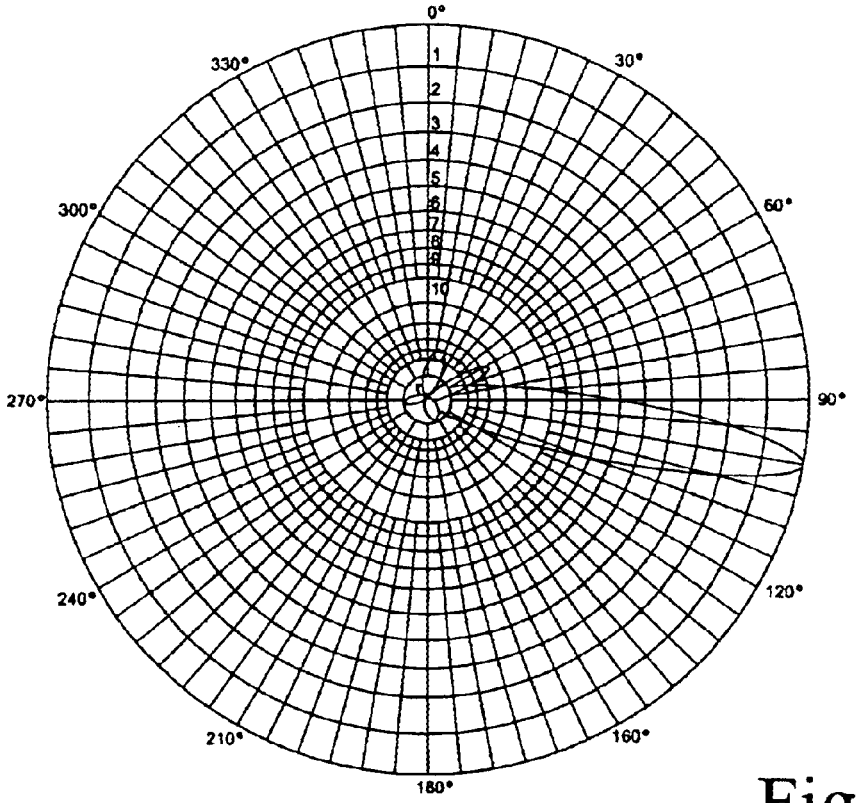

FIGS. 6*a* and 6*b* show the effect of a correspondingly designed antenna on the vertical polar diagram. A relatively small phase difference between the five dipoles which are shown schematically there results in a relatively small vertical depression angle (e.g., of 4° as depicted in FIG. 6*a*), and relatively large phase difference, set via the radio-frequency phase shifter group which has been explained, results in a relatively large vertical depression angle (e.g., of 10° as depicted in FIG. 6*b*).

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. A radio-frequency phase shift assembly for coupling to a feed line, comprising:

at least first and second stripline sections which are arranged concentrically, said at least first and second stripline sections for coupling to at least two different pairs of antenna radiating elements driven with different phase angles (ϕ) at mutually offset tapping points, a tapping element pivotable about a pivoting axis, the tapping element having a first tapping section for said first stripline section and having a second tapping section for said second stripline section, said first and second tapping sections being respectively pivotable over the associated first and second stripline sections and being coupled thereto, at least first and second connection lines, the tapping element being connected to said feed line such that the feed line is electrically connected via the first and second connection lines to the first and second tapping sections associated with said first and second stripline sections, wherein the tapping element comprises a pointer element which rotates about the pivoting axis, and wherein the second connection line is disposed with respect to the second stripline section by extending the first connection line which leads to the first tapping section.

2. The phase shift assembly as claimed in claim 1, wherein the at least first and second stripline sections have different impedance values.

3. The phase shift assembly as claimed in claim 1, wherein the first and second connection lines comprise transformers which share power in a predefined manner between the tapping sections of the at least first and second stripline sections.

4. The phase shift assembly as claimed in claim 1, wherein the tapping element comprises a radial point element originating from the pivoting axis.

5. The phase shift assembly as claimed in claim 1, wherein the at least first and second stripline sections comprise an innermost stripline section and an outermost stripline section, respectively, and wherein the share of the power fed in via the feed line decreases from the innermost stripline section to the outermost stripline section.

6. The phase shift assembly as claimed in claim 1, wherein the at least first and second stripline sections comprise an innermost stripline section and an outermost stripline section, the innermost and outermost stripline sections unequally sharing power fed in via the feed line.

7. The phase shift assembly as claimed in claim 1, wherein the at least first and second stripline sections, are fed with virtually the same power.

8. The phase shift assembly as claimed in claim 1, wherein at least one of the radius and diameter of the stripline sections increases by a constant factor.

9. The phase shift assembly as claimed in claim 1, wherein the phase shift assembly operates at a predetermined RF wavelength, and the distances between the stripline sections are 0.1 to 1.0 times the predetermined RF wavelength.

10. The phase shift assembly as claimed in claim 1, wherein the at least first and second tapping sections comprise capacitively coupled tapping sections each composed of flat strip conductors, and a dielectric disposed between said flat strip conductors.

11. The phase shift assembly as claimed in claim 1, further including a center tap electrically connected to the feed line, a capacitive coupling being provided between the center tap electrically connected to the feed line and a coupling section, said coupling section being electrically connected to the tapping element, said capacitive coupling comprising a dielectric provided between the at least first and second stripline sections.

12. The phase shift assembly as claimed in claim 1, further including a conductive, base plate antenna reflector, said at least first and second stripline sections and said tapping element being disposed on said reflector.

13. The phase shift assembly as claimed in claim 1, further including a metallic cover shielding said phase shift assembly.

14. The phase shift assembly as claimed in claim 1, further including a cover, and wherein the connection line and the at least first and second stripline sections, together with a cover defines a stripline.

15. The phase shift assembly as claimed in claim 1, wherein the at least first and second stripline sections each have a defined characteristic impedance.

16. The phase shift assembly as claimed in claim 1, further including a reflector, a dielectric, and a center tap for the tapping element that is separated from, and is held above, the reflector by a dielectric.

17. The phase shift assembly as claimed in claim 1, wherein the at least first and second stripline sections are curved.

18. The phase shift assembly as claimed in 17, wherein the at least first and second stripline sections have center points, the at least first and second stripline sections are in the form of circle segments, said at least first and second stripline section center points being arranged such that they run in the form of circle segments around a common center point.

19. The phase shift assembly as claimed in claim 1, wherein the center points of the at least first and second stripline sections lie on the pivoting axis of the tapping element.

20. The phase shift assembly as claimed in claim 1, wherein the center points of the at least first and second stripline sections and the center point of the pivoting axis are offset with respect to one another.

21. The phase shift assembly as claimed in claim 1, wherein the at least first and second stripline sections have different thicknesses.

22. An RF phase shifter comprising:

plural arcuate stripline elements of different lengths; and a pivotable radial tapping element capacitively coupled to tap each of said plural arcuate stripline elements simultaneously, said radial tapping element rotating about a pivoting axis, said radial tapping element dividing power unequally between said stripline elements in a predefined manner while simultaneously adjusting phase angle substantially equally in each of said plural arcuate stripline elements.

23. The phase shifter of claim 22 wherein the plural stripline elements each have first and second ends for connection to respective antenna radiating elements.

24. A radio-frequency phase shift assembly coupled to a feedline, comprising:

at least two stripline sections offset with respect to one another, at least two different pairs of antenna radiating elements coupled to the at least two stripline sections and driven with different phase angles (Φ) at mutually offset tapping points, a tapping element pivotable about a pivoting axis, the tapping element having a tapping section for each stripline section, the tapping sections being pivotable over the associated stripline section and being connected thereto, the tapping element connected to the feed line such that the feed line is electrically connected via a number of connection lines to the tapping sections which are associated with respective stripline sections, wherein the stripline sections are disposed in straight lines parallel to one another, the tapping element comprises a pointer element which rotates about the pivoting axis, and the respective connection line is disposed with respect to a next, further outward stripline section by extending an inward connection line which leads to a respective further inward tapping section.

25. The phase shift assembly of claim 1 wherein the stripline sections each have 50 ohms of impedance.

* * * * *

US006850130C1

(12) INTER PARTES REEXAMINATION CERTIFICATE (708th)

United States Patent
Gottl et al.

(10) Number: US 6,850,130 C1
(45) Certificate Issued: Oct. 23, 2013

(54) HIGH-FREQUENCY PHASE SHIFTER UNIT HAVING PIVOTABLE TAPPING ELEMENT

(75) Inventors: Maximilian Gottl, Frasdorf (DE); Roland Gabriel, Griesstätt (DE); Mathias Markof, Halfing (DE)

(73) Assignee: Kathrein-Werke KG, Rosenheim (DE)

Reexamination Request:
No. 95/001,050, Jun. 12, 2008

Reexamination Certificate for:

| | |
|---|---|
| Patent No.: | **6,850,130** |
| Issued: | **Feb. 1, 2005** |
| Appl. No.: | **10/049,809** |
| Filed: | **Feb. 19, 2002** |

(21) Appl. No.: 95/001,050

(22) PCT Filed: Jul. 27, 2000

(86) PCT No.: PCT/EP00/07236

§ 371 (c)(1), (2), (4) Date: Feb. 19, 2002

(87) PCT Pub. No.: WO01/13459

PCT Pub. Date: Feb. 22, 2001

(30) Foreign Application Priority Data

Aug. 17, 1999 (DE) ..... 199 38 862

(51) Int. Cl.
*H01P 1/18* (2006.01)

(52) U.S. Cl.
USPC ..... 333/161; 333/156

(58) Field of Classification Search
None
See application file for complete search history.

(56) References Cited

To view the complete listing of prior art documents cited during the proceeding for Reexamination Control Number 95/001,050, please refer to the USPTO's public Patent Application Information Retrieval (PAIR) system under the Display References tab.

*Primary Examiner* — James Menefee

(57) ABSTRACT

An improved radio-frequency phase shift assembly includes at least one further stripline section arranged concentrically with respect to a first stripline section. Further connection lines are provided, via which an electrical connection is produced at least indirectly from the feed line to the respective tapping section associated with a stripline section. Two different pairs of antenna radiating elements can be driven with different phase angles (ϕ) at mutually offset tapping points on the at least two stripline sections. The plurality of connection lines are mechanically connected to one another.

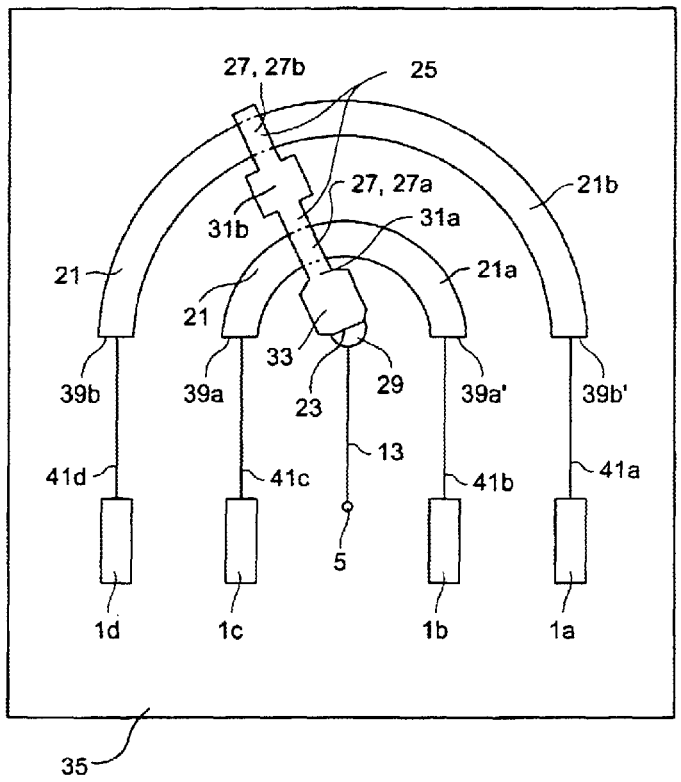

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-19, 22 and 25 is confirmed.

Claim 23 is determined to be patentable as amended.

New claims 26-27 are added and determined to be patentable.

Claims 20, 21 and 24 were not reexamined.

23. [The] *An RF* phase shifter [of claim 22] *comprising:*

*plural arcuate stripline elements of different lengths; and*

*a pivotable radial tapping element capacitively coupled to tap each of said plural arcuate stripline elements simultaneously, said radial tapping element rotating about a pivoting axis, said radial tapping element dividing power unequally between said stripline elements in a predefined manner while simultaneously adjusting phase angle substantially equally in each of said plural arcuate stripline elements,* wherein the plural stripline elements each have first and second ends for connection to respective antenna radiating elements.

*26. A radio-frequency phase shift assembly for coupling to a feed line, comprising:*

*at least first and second stripline sections which are arranged concentrically, said at least first and second stripline sections for coupling to at least two different pairs of antenna radiating elements driven with different phase angles (ϕ) at mutually offset tapping points,*

*a tapping element pivotable about a pivoting axis, the tapping element having a first tapping section for said first stripline section and having a second tapping section for said second stripline section,*

*said first and second tapping sections being respectively pivotable over the associated first and second stripline sections and being coupled thereto,*

*at least first and second connection lines, the tapping element being connected to said feed line such that the feed line is electrically connected via the first and second connection lines to the first and second tapping sections associated with said first and second stripline sections,*

*wherein the tapping element comprises a pointer element which rotates about the pivoting axis, and*

*wherein the second connection line is disposed with respect to the second stripline section by extending the first connection line which leads to the first tapping section,*

*the rotatable pointer element being simultaneously capacitively coupled to said first and second stripline sections, said first stripline section being connected to a first pair of antenna radiating elements, said second stripline section being connected to a second pair of antenna radiating elements, said first and second stripline sections forming inner and outer arcs that are simultaneously intersected by a common single radial line defined by said pointer element, a single setting of said pointer element controlling the phases and power distributions of the four radiating elements comprising said first and second pair of antenna radiating elements.*

*27. A radio-frequency phase shift assembly for coupling to a feed line, comprising:*

*at least first and second stripline sections which are arranged concentrically, said at least first and second stripline sections for coupling to at least two different pairs of antenna radiating elements driven with different phase angles (ϕ) at mutually offset tapping points,*

*a tapping element pivotable about a pivoting axis, the tapping element having a first tapping section for said first stripline section and having a second tapping section for said second stripline section,*

*said first and second tapping sections being respectively pivotable over the associated first and second stripline sections and being coupled thereto,*

*at least first and second connection lines, the tapping element being connected to said feed line such that the feed line is electrically connected via the first and second connection lines to the first and second tapping sections associated with said first and second stripline sections,*

*wherein the tapping element comprises a pointer element which rotates about the pivoting axis, and*

*wherein the second connection line is disposed with respect to the second stripline section by extending the first connection line which leads to the first tapping section,*

*the rotatable pointer element being simultaneously capacitively coupled to said first and second stripline sections and the feed line and simultaneously controlling the phases and power distributions of the radiating elements, the first and second stripline sections forming inner and outer arcs that are simultaneously intersected by a common single radial line defined by the pointer element, and*

*wherein the first and second connection lines comprise transformers which share power unequally between the tapping sections of the at least first and second stripline sections.*

* * * * *